US008904986B1

(12) United States Patent
James

(10) Patent No.: US 8,904,986 B1
(45) **Date of Patent: *Dec. 9, 2014**

(54) AIR DIRECTING DEVICE FOR MOTORCYCLES

(71) Applicant: John Campbell James, Playa Del Rey, CA (US)

(72) Inventor: John Campbell James, Playa Del Rey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/194,547

(22) Filed: Feb. 28, 2014

(51) Int. Cl.
*F02M 35/10* (2006.01)
*F02M 35/04* (2006.01)

(52) U.S. Cl.
CPC ..... *F02M 35/048* (2013.01)
USPC ..... 123/184.47; 123/41.04; 123/41.22; 123/41.56; 123/184.21

(58) Field of Classification Search
CPC ... F02B 61/02; F02B 75/22; F02M 35/10013; F02M 35/162
USPC ..... 123/184.47, 41.1, 41.04, 41.22, 41.31, 123/41.56, 41.61, 41.7, 41.82 R, 184.32, 123/184.21
See application file for complete search history.

(56) References Cited

U.S. PATENT DOCUMENTS

| | | | | |
|---|---|---|---|---|
| 4,440,255 | A * | 4/1984 | Shinozaki | 180/225 |
| 4,479,676 | A | 10/1984 | Hayes | |
| 5,307,771 | A | 5/1994 | Stahel, II et al. | |
| 6,161,513 | A * | 12/2000 | Lohr et al. | 123/184.34 |
| 6,780,214 | B2 | 8/2004 | Leibold | |
| 7,357,205 | B2 * | 4/2008 | Nishizawa | 180/68.3 |
| 7,380,534 | B2 * | 6/2008 | Sekimoto | 123/198 E |
| 7,753,980 | B2 * | 7/2010 | Kobayashi et al. | 55/495 |
| 8,151,754 | B2 * | 4/2012 | Matsuda et al. | 123/184.52 |
| 8,172,029 | B2 * | 5/2012 | Nakamura | 180/315 |
| 8,268,054 | B2 * | 9/2012 | Fiello et al. | 95/273 |
| 8,652,238 | B2 | 2/2014 | James | |
| 2002/0033010 | A1 | 3/2002 | Schorn | |
| 2003/0010558 | A1 | 1/2003 | Buell et al. | |
| 2005/0051375 | A1 | 3/2005 | Momosaki | |
| 2010/0193276 | A1 | 8/2010 | Mueller | |
| 2010/0300791 | A1 * | 12/2010 | Kern | 180/229 |
| 2011/0232983 | A1 | 9/2011 | Abe et al. | |
| 2011/0308874 | A1 * | 12/2011 | Tanaka | 180/219 |
| 2013/0146012 | A1 * | 6/2013 | Tanaka | 123/184.53 |

* cited by examiner

*Primary Examiner* — Noah Kamen
*Assistant Examiner* — Long T Tran
(74) *Attorney, Agent, or Firm* — Patent Law Offices of Michael E. Woods; Michael E. Woods

(57) ABSTRACT

An air directing device for motorcycles with an engine air cleaner bottom housing. An external air plenum forms both an engine-air intake channel and a rearward cylinder cooling channel by coupling (e.g., directly attaching) the external air plenum to an air filter. The external air plenum defining a forward-facing inlet port and an engine-facing outlet port (disposed over a portion of the rearward cylinder) with the two channels in fluid communication with the inlet port.

2 Claims, 6 Drawing Sheets

AIR DIRECTING DEVICE FOR MOTORCYCLES

FIELD OF THE INVENTION

The present invention relates generally to motorcycle accessories and more specifically, but not exclusively, to an air directing cooling device for a motorcycle engine.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Motorcycles are two wheeled motorized vehicles that have become a standard means of transportation for people in many locations around the world. Many motorcycles have air cooled engines, rather than the standard water cooled engines found in typical four wheeled vehicles.

Some motorcycle engines, such as many models made by the Harley Davidson Motorcycle Company, include two cylinders where there is one forward facing cylinder that is closer to the front of the motorcycle and a second adjacent cylinder that is closer to the rear of the motorcycle. The cylinders tend to be situated in a V shaped pattern with an air cleaner assembly located near the upper portion of the V.

Due to the location of the two cylinders with respect to air flow as the motorcycle is in forward motion, the rear cylinder tends to be cooled less than the front cylinder creating an unwanted heat buildup in the rear cylinder. This heat buildup can be damaging to the engine and possibly cause the engine to overheat and even shut down completely. To solve this problem, it would be helpful to have an air directing means that helps bring cool air to the rear cylinder of a twin cylinder engine.

What is needed is a system and method for efficiently and simply cooling a rearward cylinder of an air-cooled engine having fore/aft arranged cylinders, more specifically but not exclusively to V-twin 45-degree, air-cooled engine design.

BRIEF SUMMARY OF THE INVENTION

Disclosed is a system and method for efficiently and simply cooling a rearward cylinder of an air-cooled engine having fore/aft arranged cylinders, more specifically but not exclusively to V-twin 45-degree, air-cooled engine design.

The following summary of the invention is provided to facilitate an understanding of some of technical features related to cooling a rear cylinder of an air-cooled engine have a forward/rearward arrangement of cylinder and is not intended to be a full description of the present invention. A full appreciation of the various aspects of the invention can be gained by taking the entire specification, claims, drawings, and abstract as a whole. The present invention is applicable to other air-cooled engines in addition to the twin-V Harley Davidson air-cooled engine.

An object of the present invention is to provide an air directing device for a motorcycle that directs cool air to the rear cylinder of a two cylinder motorcycle engine.

Another object of the invention is to provide an air directing device for a motorcycle that is specifically tailored for a specific engine, such as, for example, Harley Davidson two cylinder motorcycles.

Another object of the invention is to provide an air directing device for a motorcycle that provides a channel formed with the air cleaner housing to direct cool air to the rear cylinder of a two cylinder engine.

A further object of the invention is to provide an air directing device for a motorcycle that provides an air scoop member mounted to the outside housing of an air cleaner to direct cool air to the rear cylinder of a two cylinder engine.

Yet another object of the invention is to provide an air directing device for a motorcycle that is easy to install.

An air directing device for motorcycles with an engine air cleaner assembly including an engine air cleaner bottom housing. An external air plenum forms both an engine-air intake channel and a rearward cylinder cooling channel by coupling (e.g., directly attaching) the external air plenum to an air filter of the engine air cleaner assembly and mating to the engine air cleaner bottom housing. The external air plenum defining a forward-facing inlet port and an engine-facing outlet port (disposed over a portion of the rearward cylinder) with the two channels in fluid communication with the inlet port.

An air directing device for a motorcycle including an engine having a forward cylinder, a rear cylinder disposed rearwardly of and in line with the forward cylinder, and an air cleaner assembly for intake air for the engine disposed laterally of and overlying outside portions of both of the cylinders, includes an engine air cleaner housing bottom portion of the air cleaner assembly, the engine air cleaner housing bottom portion including a sidewall extending away from a base plate; an air filter coupled to the engine air cleaner housing bottom portion and providing an engine air inlet path through the air filter into the engine through the engine air cleaner housing bottom portion; and an external air plenum, coupled to the an engine air cleaner housing bottom portion and enclosing the air filter, the external air plenum defining a forward-facing inlet port, an engine-facing outlet port, and an air communication channel extending from the inlet port past the air filter to the outlet port; wherein an air intake channel extends from the inlet port into the air filter and then into one or more air communication structures coupled into the engine through the engine air cleaner housing bottom portion; and wherein the outlet port overlies an outside portion of the rear cylinder.

A method for defining a cooling air path for a motorcycle including an engine having a forward cylinder, a rear cylinder disposed rearwardly of and in line with the forward cylinder, and an air cleaner assembly providing an intake air channel to the engine through an engine air cleaner housing bottom portion, the air cleaner assembly disposed laterally of and overlying outside portions of both of the cylinders and including an air filter coupled to the engine air cleaner housing bottom portion and in fluid communication with the intake air channel, includes a) coupling an external air plenum to the engine air cleaner housing bottom portion defining both a forward-facing inlet port and an engine-facing outlet overlying a portion of an external surface of the rearward cylinder; and b) forming concurrently, responsive to the coupling element a), both a first air communication channel extending from the forward-facing aperture to the air filter and a second air communication channel extending from the forward-facing aperture to the engine-facing aperture past the air filter.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Figure 1:
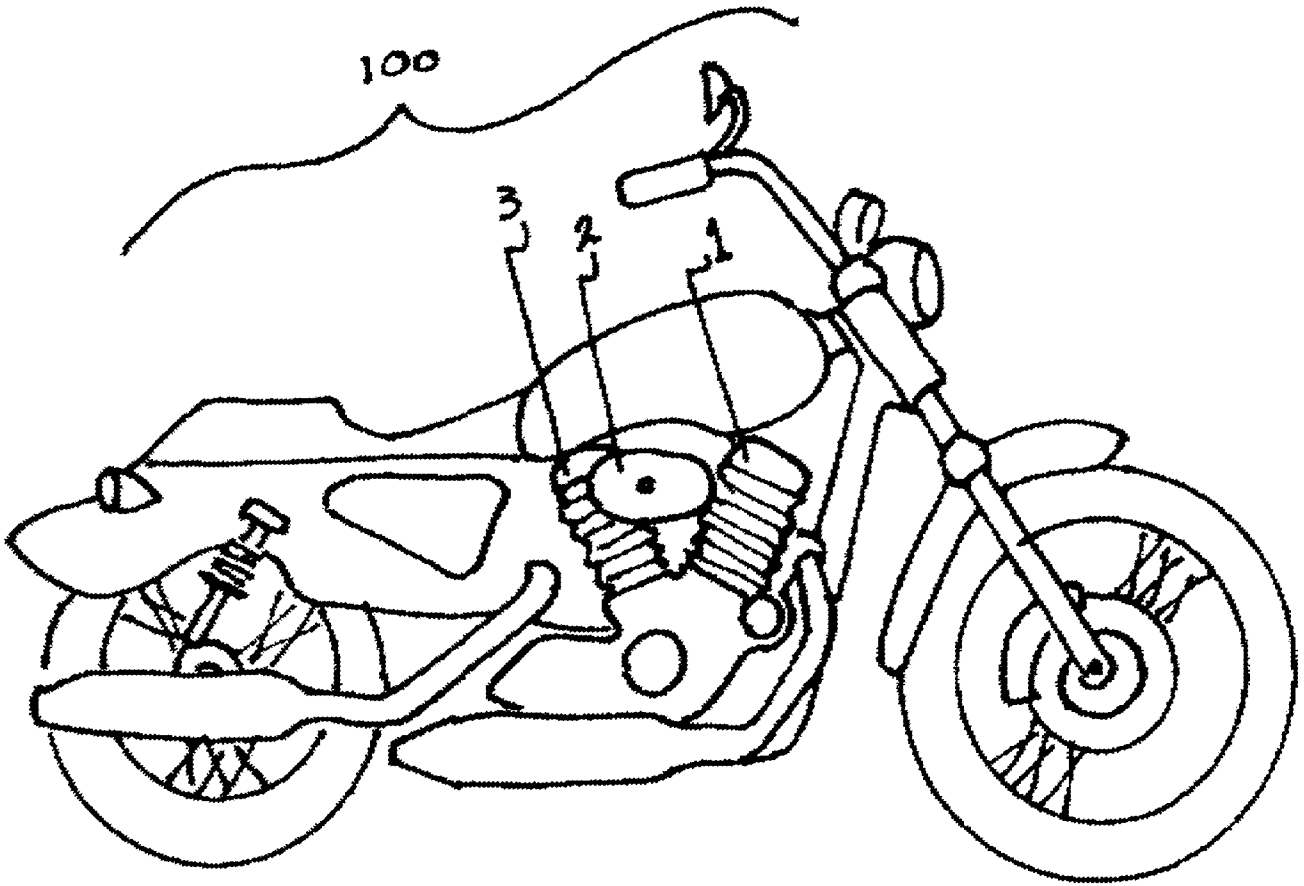
FIG. 1 illustrates a side view of a Harley Davidson twin cylinder motorcycle.

Embodiments of the present invention provide a system and method for efficiently and simply cooling a rearward cylinder of an air-cooled engine having fore/aft arranged cylinders, more specifically but not exclusively to V-twin 45-degree, air-cooled engine design. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

The following definitions apply to some of the aspects described with respect to some embodiments of the invention. These definitions may likewise be expanded upon herein.

As used herein, the term "or" is generally intended to mean "and/or" unless otherwise indicated.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

U.S. Pat. No. 8,652,238 issued 18 Feb. 2014 to the applicant includes a solution to the problem described herein, this US patent, hereby expressly incorporated by reference thereto for all purposes, is herein referred to as the incorporated patent. However, some of the described embodiments of that solution include modification to a bottom housing of an air cleaner assembly to add one or more apertures, addition of an inner air plenum to form an air communication channel extending from a forward aperture that "scoops" in air and directs it out a rearward aperture where the channel air is directed onto an exterior surface of a rearward cylinder of the engine, and an optional second exterior plenum that was positioned on top of an existing top housing of the air cleaner assembly that produced a second independent air channel scooping air from a forward location and directing it onto an external surface of a rearward portion.

FIG. 1 illustrates a side view of a Harley Davidson twin cylinder motorcycle 100, which is representative of an environment for the present engine: multiple externally-exposed cylinders of an air-cooled engine in which a forward cylinder 1, and an air cleaner assembly having a stock top air cleaner housing top 2, is disposed ahead of a rearward cylinder 3. In this illustration, forward cylinder 1 and rearward cylinder 3 define an upward-opening "V" shape with the air cleaner assembly positioned between the cylinders. Lateral wing portions of the air cleaner assembly overlap portions of the two cylinders. A specific part of the air cleaner assembly that is shown is referred to herein as stock air cleaner top housing 2.

Figure 2:
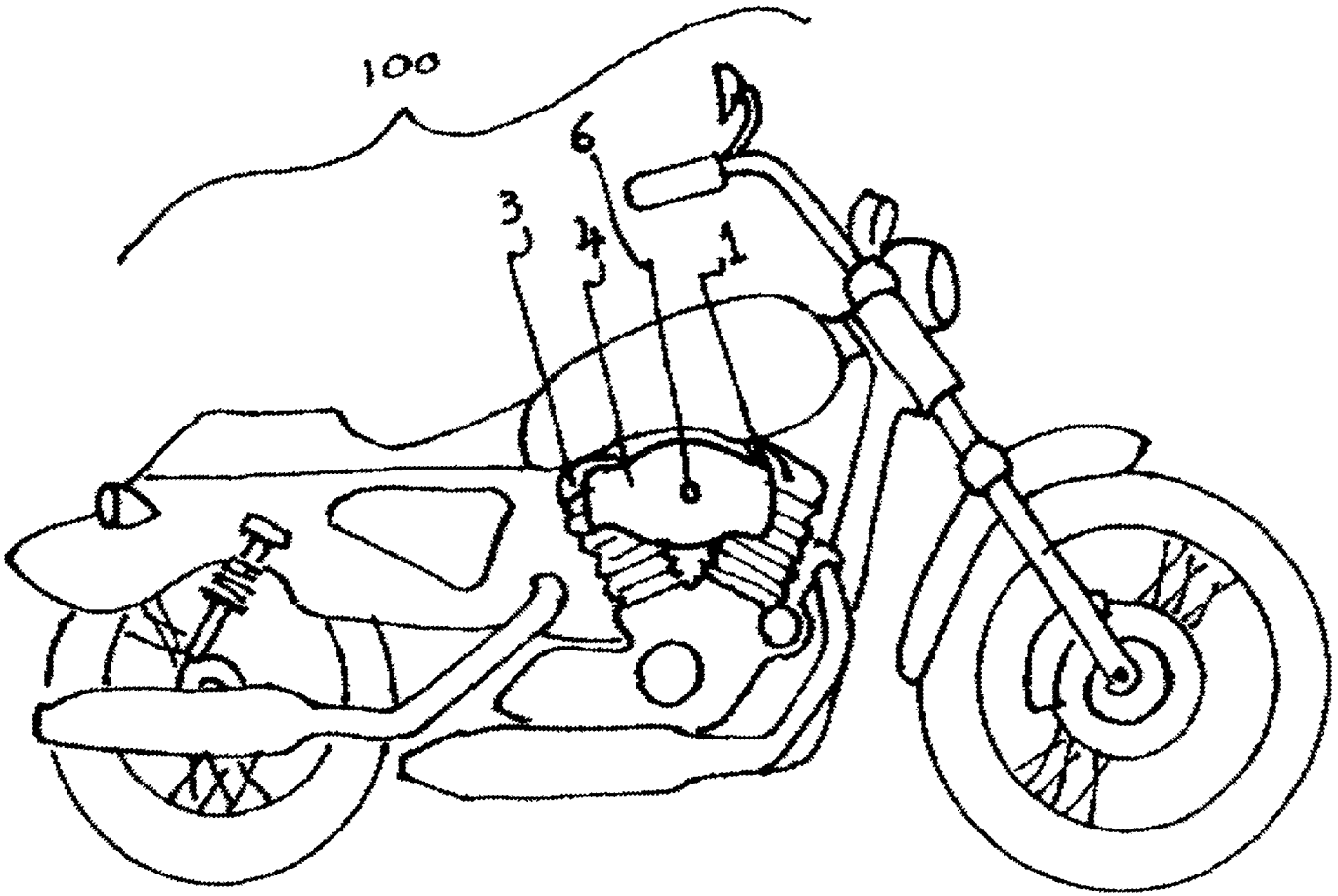
FIG. 2 illustrates a side view of a Harley Davidson twin cylinder motorcycle with a top plan view of an external air plenum used as part of an air cleaner assembly.

FIG. 2 illustrates a side view of Harley Davidson twin cylinder motorcycle 100 with a top plan view of an external air plenum 4 attached to the air cleaner assembly by an attachment system 6 (e.g., a screw, bolt, or the like). In this particular embodiment, in contrast to that illustrated and described in the incorporated patent, external air plenum 4 replaces stock air cleaner top housing 2. This simple expedient makes configuration and use simple; a user need only remove stock air cleaner top housing 2 and attach external air plenum 4 in its place to improve cooling of rearward cylinder 3.

Figure 3:
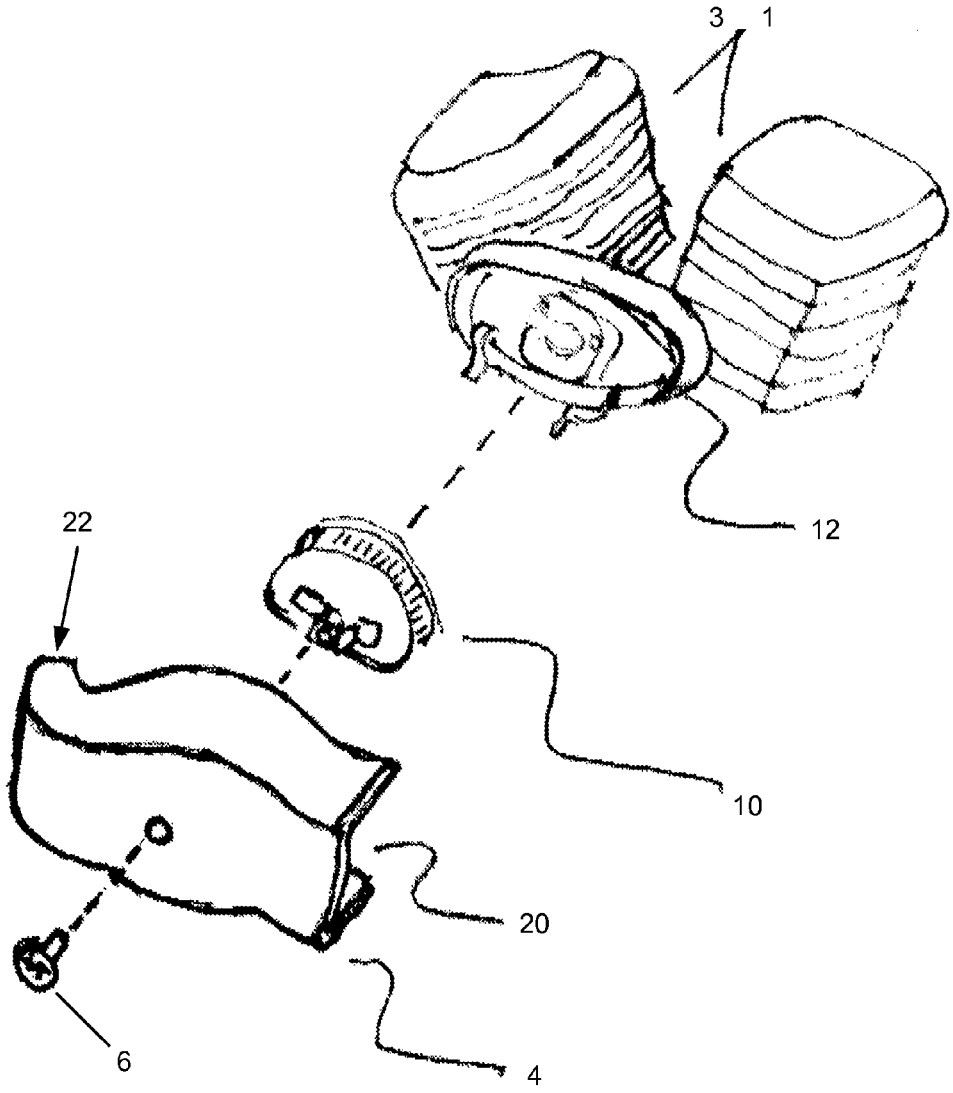
FIG. 3 illustrates an exploded view of the air cleaner assembly including the external air plenum illustrated in FIG. 2.

FIG. 3 illustrates an exploded view of the air cleaner assembly including external air plenum 4 illustrated in FIG. 2. In addition to external air plenum 4 and attachment system 6, illustrated in FIG. 3 is a stock air filter 10 (though some embodiments may include a different type of air filter) and a bottom housing 12 that, in this embodiment, is not required to be modified as preferred in the incorporated patent.

External air plenum 4 includes a forward-facing inlet port (e.g., an aperture) 20 and an engine-facing outlet port 22 and a cavity-defining structure that provides an air communication channel from inlet port 20 to outlet port 22 past air filter 10. External air plenum 4 is sized and shaped to mate to bottom housing 12 in much the same manner with similar but enhanced function as top housing 2 illustrated in FIG. 1 while providing a cooling function by forming and maintaining the air communication channel with the particular desired arrangement. In the illustrated embodiment, external air plenum 4 is connected to both air filter 10 and bottom housing 12. In other embodiments, external air plenum 4 may be coupled to one or both of air filter 10 and bottom housing 12. Also as illustrated, inlet 20 overlies a portion of forward cylinder 1 while in other embodiments it may be forwardly extended beyond forward cylinder 1.

The particular desired arrangement is further elaborated below but includes a mechanism for collecting and scooping air (i.e., inlet port 20), a mechanism to route a portion of that collected and scooped air to outlet port 22 (i.e., the air communication channel) and to the air filter, and a mechanism to direct the routed air onto an external exposed portion of rearward cylinder 3 (i.e., an the engine-facing outlet port 22). Inlet port 20 is forward facing (that is in this illustrated embodiment, towards a front wheel of motorcycle 100) and is designed for the collection of air, particularly during engine-driven movement of motorcycle 100. Outlet port 22 is rearward (that is, towards a rear wheel) and downward (that is, inward and towards the portion of the exposed external rearward cylinder 3). In this fashion, a portion of air entering into inlet port 20 during motion of motorcycle 100 exits from outlet port 22 onto the portion of the exposed external rearward cylinder 3. And by this expedient, simply and efficiently increases a cooling of the rearward cylinder during motion. This is particularly important in arrangements similar to motorcycle 100 as rearward cylinder 3 typically becomes hotter than forward cylinder 1 because of its location directly behind.

Figure 4:
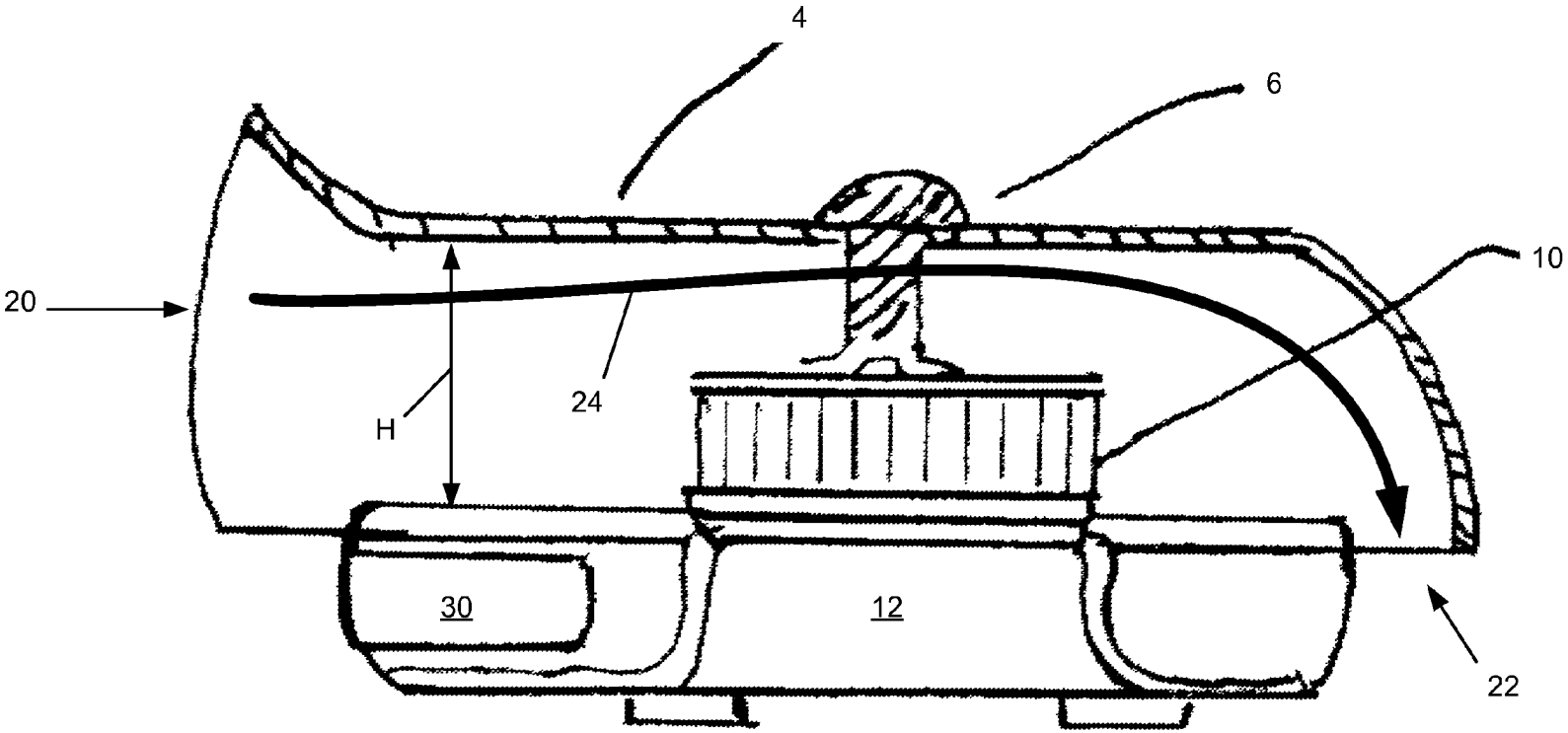
FIG. 4 illustrates a horizontally disposed section view of the air cleaner assembly.

FIG. 4 illustrates a horizontally disposed section view of the air cleaner assembly (in this case, looking down from a position above motorcycle 100). External air plenum 4 of the illustrated embodiment directly attaches to air filter 10 by use of attachment system 6. External air plenum 4 serves both as a replacement for top housing 2 but also as a mechanism to create an air communication channel 24 to direct air, during motion of motorcycle 100, from inlet port 20 to outlet port 22. Some versions of bottom housing 12 are provided by the manufacturer with an aperture 30; the present invention does not require that any additional apertures be formed in bottom housing 12 though they may be used, when present. In some implementations, aperture 30 may supplement inlet air flow as aperture 30 is in fluid communication with air communication channel 24 and may be designed to contribute an increased volume of air moving through air communication channel 24. In some implementations, it may be possible to use a forward facing aperture 30 in lieu of inlet port 20. In which case air communication channel extends from aperture 30 to outlet port 22 past and/or around air filter 10.

As illustrated, external air plenum 4 extends further away from bottom housing 12 than would traditionally be the case with top housing 2. The embodiment illustrated in FIG. 4 increases a cooling volume of air moving along air communication channel 24 by appropriately creating an internal volume of an internal cavity formed by the mating of external air plenum 4 to bottom housing 12. In some implementations, it may be desired to reduce a height of this cavity (height, H, being a distance by which a furthermost surface (typically planar and parallel to the parallel bottom housing but not required to be so formed) as this defines an amount by which external air plenum 4 extends out from a side of motorcycle 100. For some applications, it is possible to further increase a volume of air communication channel 24 by increasing a width, W, of air communication channel 24 in addition, or in lieu of, adjusting height H. Width W, as illustrated in FIG. 4, is perpendicular to height H and extends out of the plane of the illustration. In some instances, height H may be slightly greater than a distance by which air filter 10 extends from bottom housing 12 (making attachment system 6 shorter and having less space, if any, between an outer wall of external air plenum 4 and air filter 10. In some implementations, it may be desirable for attachment system 6 to rigidly support and space that portion of the outer wall of external air plenum 4 to help maintain a volume of the cavity through which air communication channel 24 is formed. For example, when implemented as a mounting bolt, attachment system may include a shoulder independently supporting a portion of the exterior wall of external air plenum 4 and maintaining a desired spacing/gap.

Figure 5:
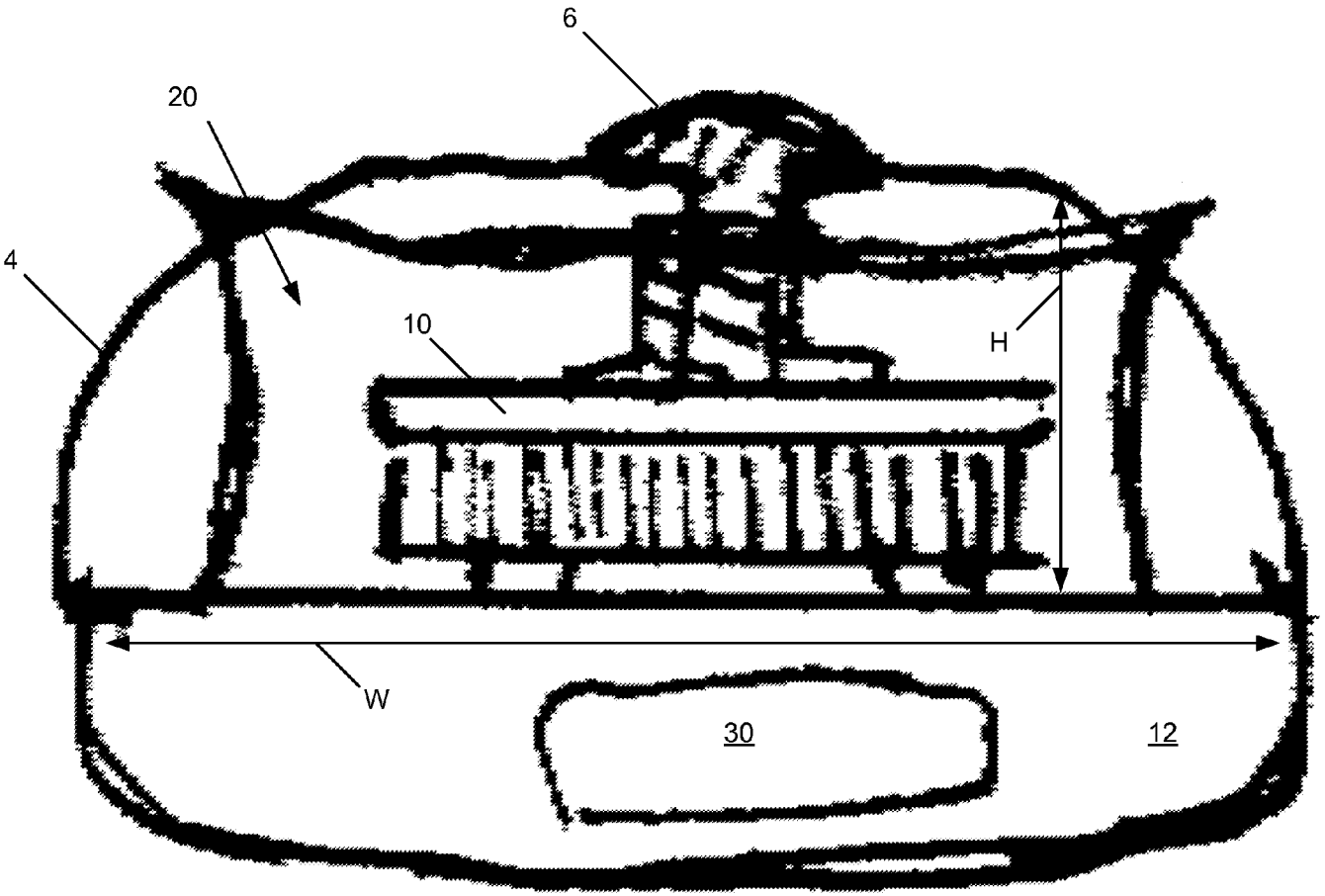
FIG. 5 illustrates a front section view of the air cleaner assembly.
Figure 6:
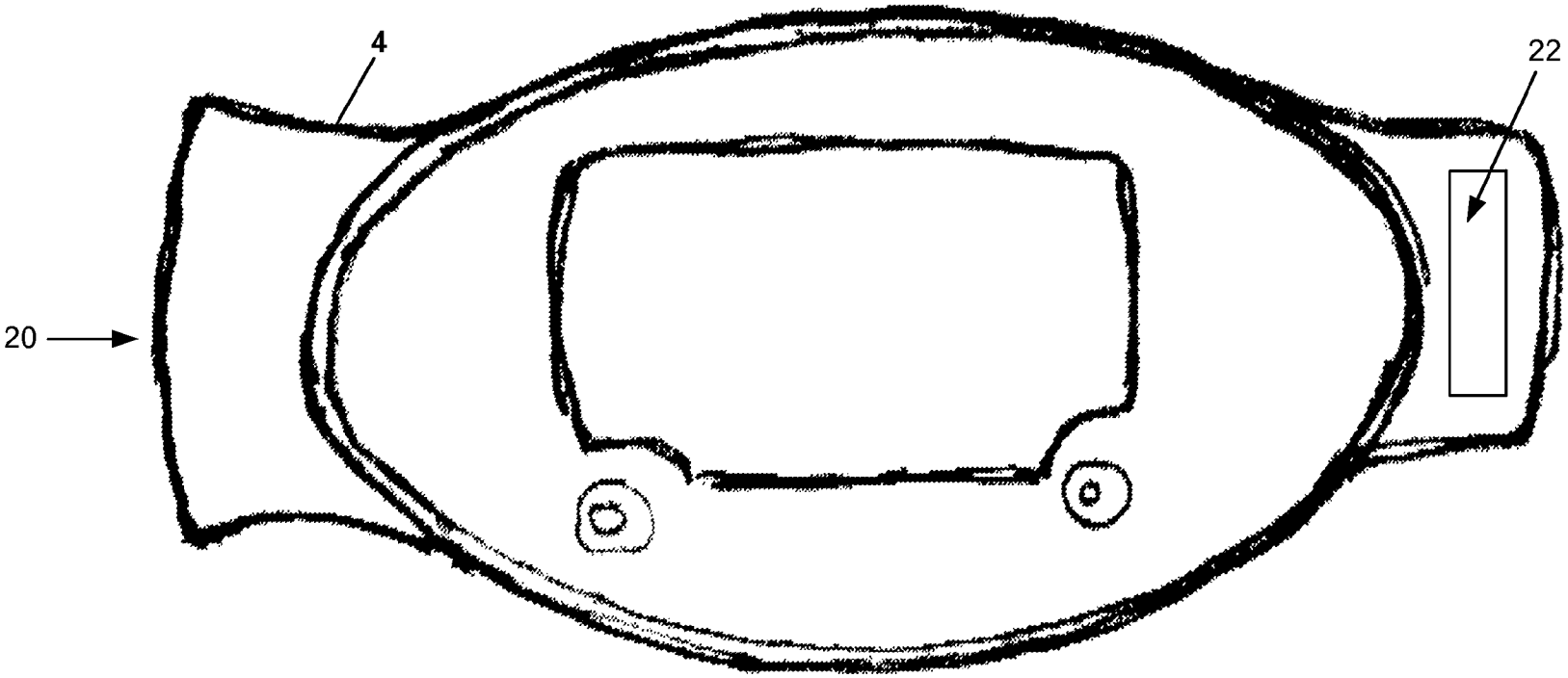
FIG. 6 illustrates a bottom plan view of the air cleaner assembly.

FIG. 5 illustrates a front section view of the air cleaner assembly (i.e., as illustrated, when looking from a vantage point ahead of motorcycle 100 back towards the air cleaner assembly with motorcycle 100 laying on its left side). FIG. 6 illustrates a bottom plan view of the air cleaner assembly from a vantage point at motorcycle 100 looking outward towards a right-hand side.

In operation, air intake for the engine flows through air filter 10 from air communication channel 24 illustrated in FIG. 4. In the embodiment illustrated in FIG. 3 and FIG. 4, for implementations without aperture 30, inlet port 20 serves a dual-purpose of providing cooling air to rearward cylinder 3 along air communication channel 24 while also providing a source of engine inlet air as filtered by air filter 10.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An air directing device for a motorcycle including an engine having a forward cylinder, a rear cylinder disposed rearwardly of and in line with the forward cylinder, and an air cleaner assembly for intake air for the engine disposed laterally of and overlying outside portions of both of the cylinders, comprising:

an engine air cleaner housing bottom portion of the air cleaner assembly, said engine air cleaner housing bottom portion including a sidewall extending away from a base plate;

an air filter coupled to said engine air cleaner housing bottom portion and providing an engine air inlet path through said air filter into the engine through said engine air cleaner housing bottom portion; and an external air plenum, coupled to said an engine air cleaner housing bottom portion and enclosing said air filter, said external air plenum defining a forward-facing inlet port, an engine-facing outlet port, and an air communication channel extending from said inlet port past said air filter to said outlet port; wherein an air intake channel extends from said inlet port into said air filter and then into one or more air communication structures coupled into the engine through said engine air cleaner housing bottom portion; and wherein said outlet port overlies an outside portion of the rear cylinder.

2. A method for defining a cooling air path for a motorcycle including an engine having a forward cylinder, a rear cylinder disposed rearwardly of and in line with the forward cylinder, and an air cleaner assembly providing an intake air channel to the engine through an engine air cleaner housing bottom portion, the air cleaner assembly disposed laterally of and overlying outside portions of both of the cylinders and including an air filter coupled to the engine air cleaner housing bottom portion and in fluid communication with the intake air channel, comprising:

a) coupling an external air plenum to the engine air cleaner housing bottom portion defining both a forward-facing inlet port and an engine-facing outlet overlying a portion of an external surface of the rearward cylinder; and b) forming concurrently, responsive to said coupling element a), both a first air communication channel extending from said forward-facing aperture to the air filter and a second air communication channel extending from said forward-facing aperture to said engine-facing aperture past the air filter.

* * * * *